United States Patent [19]

Randon

[11] 4,118,030

[45] Oct. 3, 1978

[54] METHOD OF JUGGLING AND APPARATUS THEREFOR

[75] Inventor: Donald Gerard Randon, Gretna, La.

[73] Assignee: Roberts Management, Inc., Houston, Tex.

[21] Appl. No.: 724,645

[22] Filed: Sep. 20, 1976

[51] Int. Cl.[2] ..... A63B 67/08

[52] U.S. Cl. ..... 273/96 R; 46/47; 272/25; 273/67 R

[58] Field of Search ..... 272/124, 25; 273/84 R, 273/84 ES, 96 R, 96 C, 106 R, 1 A, DIG. 8, 67 R, 67 A, 67 B, 67 C, 67 D, 67 DA, 67 DB, 67 DC; 46/47; D34/5 BC, 5 CT, 15 N; 135/65

[56] References Cited

U.S. PATENT DOCUMENTS

| | | | |
|---|---|---|---|
| 365,228 | 6/1887 | Bean | 273/84 |
| 1,490,651 | 4/1924 | Waldorf | 273/84 |
| 2,167,992 | 8/1939 | Olsen | 46/47 |
| 2,364,137 | 12/1944 | Gibb | 273/106 R |
| 3,528,659 | 9/1970 | Benham | 273/106 R X |

OTHER PUBLICATIONS

Peer Twirl-aton, Playthings, Aug. 1959, p. 83.
'Rubber Stick' Black Belt, May 1972, p. 29.
Lightweight Training Baton, Black Belt, Mar. 1974, p. 6.

*Primary Examiner*—Richard C. Pinkham
*Assistant Examiner*—Arnold W. Kramer
*Attorney, Agent, or Firm*—Browning, Bushman & Zamecki

[57] ABSTRACT

A method of juggling a generally elongate tubular member using a pair of cushioned tubular members in which the tubular member to be juggled is disposed across the two cushioned tubular members which are held in spaced relationship to one another in a direction outwardly from the holder and generally horizontal, an upward, rotating motion being imparted by one of the cushioned tubular members to the tubular member to be juggled such that the latter rotates one or more times in the air and is then caught on the cushioned tubular members.

7 Claims, 3 Drawing Figures

METHOD OF JUGGLING AND APPARATUS THEREFOR

BACKGROUND OF THE INVENTION

The present invention relates to a toy. More specifically, the present invention relates to a method and apparatus for juggling.

Juggling is a form of amusement which dates to ancient times. Generally it is associated with the act of maintaining several objects in motion in the air at the same time by alternately catching and tossing the objects. However, juggling may take on other forms such as the manipulation of a given object in a manner requiring unusual dexterity. Because of the relatively high degree of dexterity normally required to carry out most forms of juggling, the activity, as a form of recreation, has been limited to a relatively small segment of the population. Juggling, if it can be learned, is an enjoyable pastime, aids in developing coordination and can be therapeutic in nature in relieving anxiety and tension.

SUMMARY OF THE INVENTION

It is therefore an object of the present invention to provide an improved method of juggling.

An important object of the invention is to provide a method of juggling which can be relatively easily and quickly mastered by one having normal dexterity.

The above and other objects of the present invention will become apparent from the drawings, the description given herein and the appended claims.

In the method of the present invention, the participant grasps a generally elongate, substantially rigid member in one hand, closely adjacent one end of the member and a second substantially similar member in the other hand, closely adjacent one end of the member. The members are held in a direction pointing outwardly from the holder in spaced relationship to one another and substantially horizontal. Each of the first and second elongate members has a cushioning portion comprised of a cushioning layer of resilient material covering the greater portion of the member. A third, generally elongate, substantially rigid member is disposed on and generally transverse to the first and second members on the cushioning portion thereof. The holder then moves one of the first or second members in an upward motion with sufficient force to lift the third member off the first and second member and impart rotational movement thereto. In this manner, the third member is caused to move upwardly and spin about an axis transverse to and generally centrally of the long axis thereof. Depending on the amount of force used to impart the lifting and rotating action to the third member, the latter will rotate about the described axis a varying number of times. The rotating third member is then caught on the cushioning portions of the first and second members and the procedure repeated as desired.

DESCRIPTION OF THE PREFERRED EMBODIMENT

Figure 3:
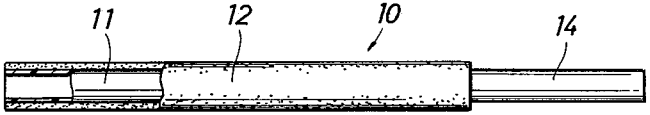
FIG. 3 is an elevational view, partly in section, showing the juggling apparatus of the present invention.

Referring first to FIG. 3, the juggling apparatus, shown generally as 10, is seen to comprise an elongate, substantially rigid, cylindrical, tubular member 11, the greater portion of which is covered with a layer of cushioning material to form a cushioning portion 12. Preferably, cushioning portion 12 extends from one end of tubular member 11 to a point intermediate the ends of tubular member 11 thus leaving an uncovered length of tubular member 11 which serves as a handle portion 14.

Tubular member 11 is "substantially rigid" in the sense that it possesses sufficient rigidity such that if it is rigidly held at one end and extended in a generally horizontal direction, it will remain substantially horizontal if a load having substantially the same mass of the tubular member 11 is disposed on tubular member 11 closely adjacent to or on the free end. Juggling apparatus 10, while preferably tubular in nature, as shown, can be solid and comprised of a lightweight plastic, wood or composition material containing wood, plastic, etc. Thus for example apparatus 11 could be made of balsa wood or some other lightweight material possessing the requisite rigidity and weight characteristics. Preferably, however, apparatus 10 will be tubular in nature and will be comprised of a polymeric material such as polyethylene, polypropylene, polyvinylchloride, polyacrylates, etc.

Generally speaking, tubular member 11 will have a length of from 24 to 36 inches and an outside diameter of from about 1 to about 2 inches. When made in tubular form from a polymeric material such as mentioned above, it will generally have a radial wall thickness of from about $\frac{1}{64}''$ to about $\frac{1}{2}''$ depending on the characteristics of the material used in its construction. For example, tubular member 11 can conveniently be made from polyethylene or polyvinylchloride having a length of 30", an outside diameter of $1\frac{1}{4}''$ and a radial wall thickness of $\frac{1}{32}''$.

Cushioning portion 12, whose function will be apparent from the description given hereafter, is comprised of a resilient material which can be either bonded to tubular member 11 or can be a separate piece, such as a cylindrical sleeve, which is somewhat elastic and can be slipped over tubular member 11 to snugly engage the latter. Cushioning portion 12 can be made from a wide variety of soft, resilient, primarily synthetic rubbers or other polymeric materials. Particularly preferred are resilient foams of materials such as polyureathane which are soft, flexible, and lightweight. Such polyureathanes are commonly used as insulation, wrapping for fragile objects in shipping and in other uses where lightweight, softness and resiliency are required.

The cushioning portion 12 of tube 10 will generally extend for the greater length of tubular member 11 and, preferably, will extend from the end of tubular member 11 distal the handle portion 14 up to the point where the handle portion 14 of tube 10 commences. Generally speaking cushioning portion 12 will extend a distance equal to about 80% of the total length of tubular member 11. Depending upon the type of resilient foam material employed in the cushioning portion 12, cushioning portion 12 will have a radial wall thickness of from about $\frac{1}{8}$ to about $\frac{1}{2}$ inch. In the preferred case, when a polyureathane foam is employed, the cushioning portion will have a radial wall thickness of approximately $\frac{1}{4}''$.

Whatever the composition of tubular member 11 and cushioning portion 12, the total weight of tube 10 should be such that a normal child of seven years of age can easily manipulate juggling tube 10 in the manner hereinafter described.

Figure 1:
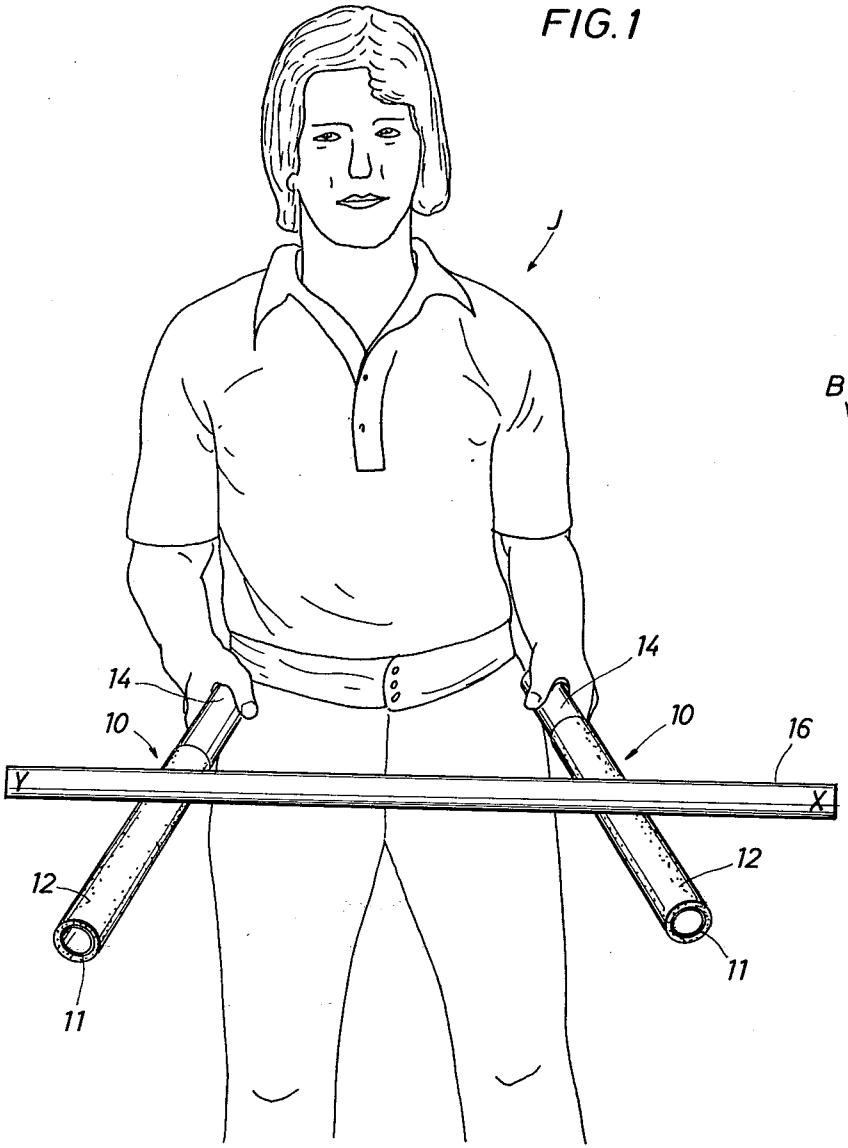
FIGS. 1 and 2 depict the use of the juggling apparatus of the present invention.
Figure 2:
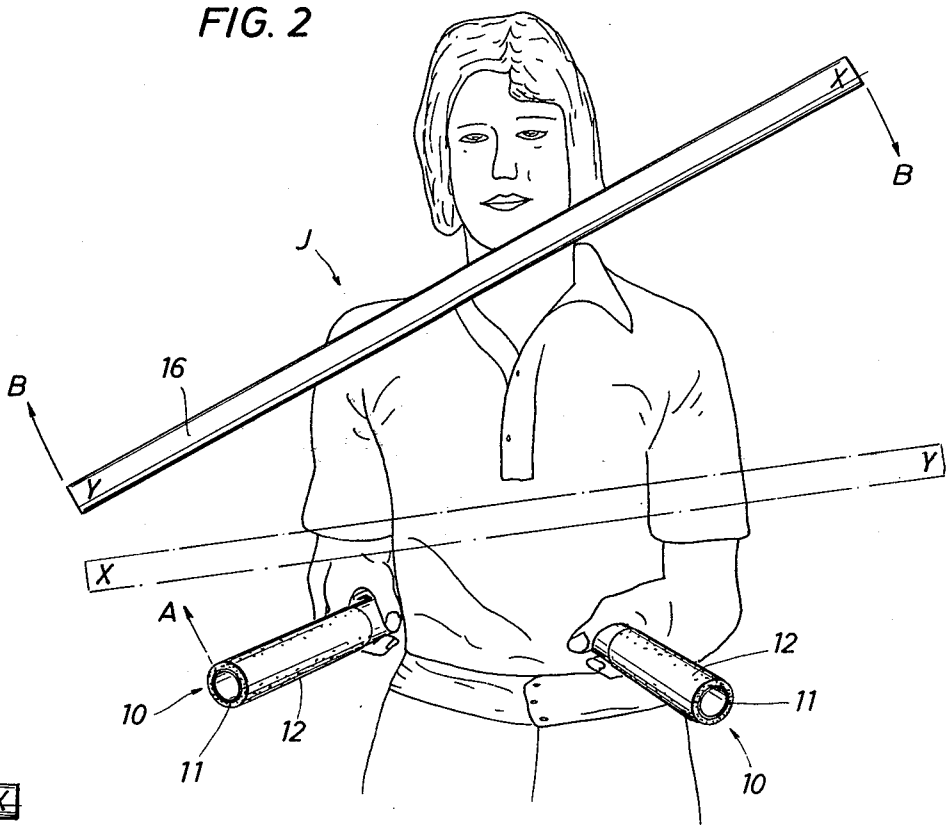

Reference is now made to FIGS. 1 and 2 for the use of juggling tube 10. It can be seen from both FIGS. 1 and 2, that the juggling method of the present invention requires the use of two juggling tubes 10 plus the use of a juggled member shown generally as tube 16. In the preferred case juggled tube 16 will be substantially identical to tubular member 11 in terms of materials of construction, dimensions, weight, etc. Thus, juggled tube 16 will usually consist of tube 10 less cushioning portion 12. Member 16, of course, can be solid rather than tubular in nature. Juggler J grasps the handle portion 14 of one tube 10 in one hand and the handle portion 14 of a second tube 10 in the other hand. With juggling tubes 10 held so as to extend outwardly from juggler J in spaced relationship, as shown in FIG. 1, and in a generally horizontal position, juggled tube 16 is then disposed transversely across members 10 and on the cushioning portions 12. Juggler J then moves one of the tubes 10 upwardly in the direction shown by arrow A (if the right hand is used) to impart a force sufficient to lift juggled tube 16 off tube 10 and to impart a rotational motion thereto. The rotational motion of tube 16 is shown by the arrows B and is about an axis which is generally transverse to the long axis of the juggled tube 16. Depending on the amount of force imparted to juggled tube 16, the latter will rotate one or more times. At a point when juggled tube 16, following its rotational, upward motion, has assumed a substantially horizontal position, it is caught upon the cushioning portions 12 of juggling tubes 10 and the procedure repeated as desired. For example, assuming only sufficient force was exerted to cause one rotation of tube 16, end Y which was to juggler J's right (see FIG. 1) when the procedure was commenced would be to juggler J's left when tube 16 was caught (see tube 16 shown in phantom in FIG. 2). If tube 16 underwent two rotations, end Y would return to its original position, etc. In any event, when juggled tube 16 has been caught, the general position shown in FIG. 1 will be resumed.

It will be appreciated that more than one participant can engage in the juggling. Thus, for example, two or more jugglers using a single juggled tube 16 can toss juggled tube 16 between one another, one participant rotating juggled tube 16, a second participant catching juggled tube 16 and then initiating the procedure again back to the original participant or to an additional participant, etc.

It will be readably apparent to those skilled in the art that juggling tube 10 provides a unique toy with which to carry out the juggling techniques of the present invention. For example, the use of three, substantially identical tubular members such as tubular members 11 or tube 16 would make it extremely difficult to perform the juggling. Tubular members 16 and 11, being substantially rigid and having a substantially smooth surface, provide little frictional engagement i.e. tube 16 could slide easily on tubular members 11. Thus, it would be initially difficult to position tube 16 on tubular members 11 as any deviation from the horizontal of tubular members 11 would result in tube 16 rolling toward or away from juggler J. The unique construction of juggling tubes 10, however, overcomes this difficulty. Cushioning portions 12, because they are soft and resilient, increase the coefficient of friction between tube 16 and juggling tubes 10. Thus, cushioning portions 12 not only reduce the tendency of tube 16 to bounce when it is caught on juggling tubes 10, it also reduces the tendency for tube 16 to slide when juggling tubes 10 are deviated somewhat from the horizontal. Thus, cushioning portion 12 acts as a shock absorber as well as a gripping surface and makes it far easier to control juggled tube 16. Thus, the use of juggling tube 10 enables one of normal dexterity to carry out the juggling method and thereby achieve the relaxing and therapeutic benefits which can be derived therefrom. The invention thus provides relaxation and enjoyment for children and adults alike.

I claim:

1. A method of juggling comprising:

grasping a first elongate member in one hand, grasping a second elongate member in the other hand, each of said first and second elongate members having a handle portion and a cushioning portion, said cushioning portion extending for the greater length of said elongate member and being comprised of a soft resilient covering over said elongate member and defining an outer friction gripping surface, said first and second elongate members being held so as to extend outwardly from the holder in spaced relationship to one another and substantially horizontal, disposing a third elongate member of substantially uniform transverse dimensions on and tranversely to said first and second elongate members, and moving one of said first and second elongate members upwardly with a force sufficient to lift said third elongate member off of said first and second elongate members and impart rotational motion to said third elongate member, said rotational motion being around an axis generally transverse to the long axis of said third elongate member;

and catching said third elongate member on said first or second elongate member, said cushioning portion being such as to act as a shock absorber reducing the tendency of said third elongate member to bounce when said third member lands on said first or second member, while further reducing the tendency of said third member to slide on said first or second member.

2. The method of claim 1 including the step of catching said third elongate member on said first and second elongate members.

3. The method of claim 1 wherein said elongate members comprise tubular members.

4. The method of claim 3 wherein said tubular members are of substantially the same length and the same external diameter.

5. The method of claim 3 wherein said tubular members are from about 24 to about 36 inches long.

6. The method of claim 3 wherein said tubular members are made from a polymeric material and said cushioning cover is comprised of a foamed, resilient polyurethane.

7. The method of claim 1 wherein said cushioning portion extends from the end of said elongate member distal said handle portion to said handle portion.

* * * * *